United States Patent [19]

D'Andrade

[11] Patent Number: 4,763,430

[45] Date of Patent: Aug. 16, 1988

[54] BATTERY OPERATED CAP GUN

[76] Inventor: Bruce M. D'Andrade, 3 Ten Eyck Rd., Whitehouse Station, N.J. 08888

[21] Appl. No.: 915,419

[22] Filed: Oct. 6, 1986

[51] Int. Cl.[4] ..... F41C 3/08; A63H 33/26

[52] U.S. Cl. ..... 42/57; 446/473

[58] Field of Search ..... 446/401, 405, 406, 473; 42/57

[56] References Cited

U.S. PATENT DOCUMENTS

| | | | |
|---|---|---|---|
| 560,045 | 5/1896 | Pruckner | 42/57 |
| 1,926,305 | 9/1933 | Peake | 42/57 |
| 2,061,471 | 11/1936 | Larson | 42/57 |
| 2,085,412 | 6/1937 | Bixler | 42/57 |
| 2,098,006 | 11/1937 | Kilgore | 42/57 |
| 2,106,648 | 1/1938 | O'Conner | 42/57 |
| 2,446,698 | 8/1948 | Fujiwara | 42/57 |
| 2,892,289 | 6/1959 | Ryan | 446/406 |
| 2,930,157 | 3/1960 | Weimer | 42/57 |
| 4,365,439 | 12/1982 | Litynski | 446/406 |

FOREIGN PATENT DOCUMENTS 930457 1/1948 France .

*Primary Examiner*—Robert A. Hafer
*Assistant Examiner*—Charles H. Harris
*Attorney, Agent, or Firm*—Kenneth P. Glynn

[57] ABSTRACT

The present invention is directed to a toy cap gun which is battery operated. The present invention cap gun has a housing which has a general configuration of a gun with a barrel and a handle. A cap roll compartment and a battery operated cap advancing-repeat firing system is also located within the housing. In addition, there is a battery chamber located within the housing and electric circuitry is included which connects the battery chamber to a drive motor and to a switch which is connected to a trigger on the gun. The battery cap advancing repeat firing system has a drive motor, a gear system, a drive shaft, a cam, a spring-loaded hammer arm, a main spring, a strike plate, and a rotatable advance means. Uniquely, the cam is a step-function drop off cam which operates to open the hammer arm and then releases it so that it repeatedly strikes the strike plate so as to create automatic firing. The cam is uniquely trifunctional so as to operate a cap roll lock, a cap advance, and the hammer of the hammer arm.

10 Claims, 2 Drawing Sheets

BATTERY OPERATED CAP GUN

BACKGROUND OF THE INVENTION

1. Field of the Invention

The present invention is directed in general to toy cap guns and more particularly is directed to battery operated toy cap guns having a high efficiency low electrical energy capability which produces automatic (repeat) cap firing by single trigger action.

2. Prior Art Statement

Toy cap guns usually depend for their operation upon trigger actuated mechanical firing systems to produce single cap firing, or, in the alternative, they have spring wound, trigger actuated automatic (repeat) firing systems. In the case of these spring wound systems, there is seldom consistent action, e.g. the firing slows down as the spring unwinds; complete, evenly timed firing of an entire cap roll is seldom possible; underwinding and overwinding can occur and eventually the spring weakens and wears out. Moreover, winding is a mechanical requirement which discourages children from using the toy and detracts from its fun.

Additionally, basic battery operated cap guns have been sold commercially, but these are inefficient in that they are merely battery driven toys which utilize the type of cam and cap advance system used in the earlier spring-loaded systems.

The present invention is directed to overcoming the shortcomings of the aforementioned earlier automatic toy cap gun by eliminating spring winding requirements and providing more efficient battery powered operation.

SUMMARY OF THE INVENTION

The present invention is directed to a toy cap gun which is battery operated. The present invention cap gun has a housing which has a general configuration of a gun with a barrel and a handle. A cap roll compartment and a battery operated cap advancing-repeat firing system are also located within the housing. In addition, there is a battery chamber located within the housing and electric circuitry is included which connects the battery chamber to a drive motor and to a switch which is connected to a trigger on the gun. The battery cap advancing-repeat firing system has a drive motor, a gear system, a drive shaft, a cam, a spring-loaded hammer arm, a main spring, a strike plate, and a rotatable advance means. Uniquely, the cam is a step-function drop off cam which is trifunctional. The cam operates to open the hammer arm and then releases it so that it repeatedly strikes the strike plate so as to create automatic firing, operates to open and close a cap roll lock and advances the cap roll.

BRIEF DESCRIPTION OF THE DRAWINGS

The present invention may be more fully understood when taken in conjunction with the description below and the accompanying drawings, wherein.

DETAILED DESCRIPTION OF THE PRESENT INVENTION

Figure 1:
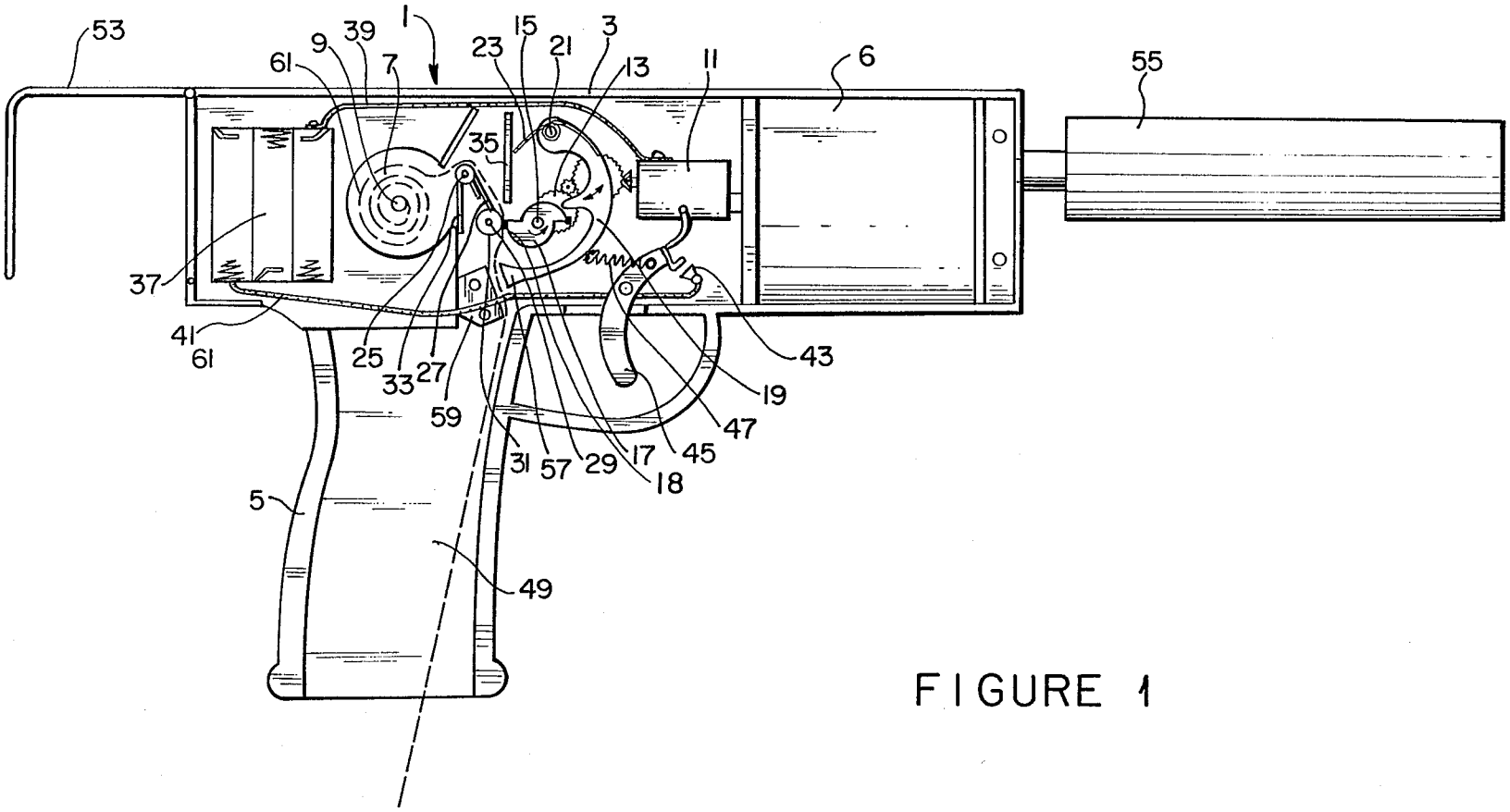
FIG. 1 is a side cut view of a preferred cap gun of the present invention; and, FIG. 2 is a portion of a side cut view of an alternative preferred hammer arm and cam of the present invention which differs from that shown in FIG. 1.

The present invention is, as mentioned, directed to a toy cap gun which is battery operated. The toy cap gun of the present invention may take on any configuration such as that of a pistol such as a Luger, a revolver, a Western-type Colt pistol, a machine gun, an "Uzi" automatic machine pistol, a space pistol, a rifle, or the like. The toy cap gun of the present invention has a housing which includes a barrel and a handle. In addition, a cap roll compartment is located within the housing and typically has the conventional cover for insertion of a cap roll. It also has a battery operated cap advancing-repeat firing system located in the housing with a drive motor, a gear system connected at one end to the drive motor and at the other end to a drive shaft, a drive shaft which is drivable from and movably connected to the gear system at one end and connected to a cam at its opposite end, a cam connected to the drive shaft which is drivable by the drive shaft and which is movably connected to a spring-loaded hammer arm, the spring-loaded hammer arm is pivotably attached to said housing at one end and movably connected to the cam and openable thereby and directed to a strike plate as its opposite end, a main spring which is attached to the hammer arm and which has adequate tension upon opening and release to drive the hammer arm against a strike plate to fire caps, a strike plate which is attached to the housing and strikably located at one end of the hammer arm and a rotatable cap advance means which is drivably connected to the motor for advancing the cap roll. In addition, the present invention toy gun has a battery chamber located within the housing, an electrical circuitry which is connected to the drive motor and to the battery chamber and includes an open circuit/closed circuit switch. It also includes a trigger which is movably connected to the housing and which is operably connected to the open circuit/closed circuit switch. When a cap roll is loaded in the cap roll compartment and fed to the cap advance means, and batteries are placed within the battery chamber and the trigger is pulled, the electrical circuitry is completed within the battery, the motor is operated and drives the gears and drive shaft resulting in the cam being rotated and cycled so as to repeatedly open and release the hammer arm. Upon opening and release of the hammer arm the hammer of the hammer arm repeatedly strikes the strike plate to fire caps while the cap advance means is driven to advance a cap roll to cause the repeated cap firing. The cam is necessarily a step-function drop off type cam which is capable of opening and releasing the hammer arm so as to effect the firing of caps. This is accomplished by the cam moving the hammer arm far enough away from the strike plate so that, coupled with the tension on the main spring, upon release of the hammer arm the hammer strikes the strike plate with enough force to fire the caps. Preferably the cam has two or more drop off points and this allows for more rapid fire, e.g. double or triple the firing power, based on a given set of gears, motor and batteries. Also, uniquely, the cam of the present invention is trifunctional in that it will operate so as to open up a lock on a roll of caps and also operate to advance the roll of caps as well as operate to open the hammer arm to effect the firing of the hammer against the strike plate. Thus, upon pulling of the trigger with a loaded battery operated toy cap gun of the present invention, there is obtained a virtually smooth, continual, repeat, rapid fire of caps and this can be sustained through an entire roll. Rather than having to rewind and worry about the possibility of rewinding in the middle of a roll of caps, the user has to merely insert a new roll of caps and continue to enjoy the toy.

While the present invention battery operated cap gun is designed for long life and has been arranged to receive, for example, three AA type batteries (1.5 volts each) or a 4.5 volt system. It would be within the purview of the artisan to rearrange the present invention so as to rely upon three volts or six volts or some other arrangement without exceeding the scope of the present invention. The choice of battery size and life of batteries within the system is limited only by the necessary power to drive the system on the low end and simply by the weight and size of batteries on the high end. In any event, is has been found that the 4.5 volt system which is represented in FIG. 1 herein, is an effective design for the present invention. Moreover, in the present invention wherein a trifunctional cam is utilized, the number of moving parts and power requirements are diminished and a most efficient product results.

Referring now to FIG. 1, there is shown toy cap gun (1) which includes housing (3) having the general external appearance of a gun. Housing (3) has handle (5) an a barrel (6). It also has a cap roll compartment (7) and a battery operated cap advancing-repeat firing system which includes drive motor (11) which is connected to gear system (13) and drive shaft (15). Drive shaft (15) drives double drop off rise cam (17) which rotates as shown by the arrow. Cam (17) moves hammer arm (19) back and forth as illustrated by the arrow shown on hammer arm (19). Hammer arm (19) is pivotably attached to housing (3) at pin (21) and pin (21) has a main spring (23) which keeps hammer arm (19) biased towards cam (17). There is a stationary pin (9) shown in in the center of cap roll compartment (7) for insertion of a cap roll which is illustrated by the dotted lines shown on the drawing.

Stationary cap feeder shaft (25) includes a flat cap feeder slide (27) which is connected at its upper end to stationary cap feeder shaft (25) and at its lower end to a movable cap feeder shaft (29). Cap feeder shaft (29) and roller (31) operate together so that roller (31) rotates as a roll of caps slides over it. However, cap feeder roller (31) along with cap feeder slide (27) is biased against lock brace (35) which is merely a stationary wall, by the spring action of spring (33) which pushes slide (27) with shaft (29) and roller (31) against brace (35). However, as can be seen, as cam (17) rotates beyond its drop off point, raised surface (18) of cam (17) will operate to push roller (31) and slide (27) away from lock brace (35) and this will free up the cap roll for advancement. In addition, cam (17) may have serrated edges instead of raised surfaces (18) or in addition thereto, such that when it presses against the cap roll, advancement is enhanced.

Battery chamber (37) is shown and in this case is adapted to receive 3 AA batteries and electrical circuitry wires (39) and (41) are connected thereto in conjunction with open circuit/closed circuit switch (43). Trigger (45) is arranged within the housing as shown and has spring (47) to keep it in the open position. Trigger spring (47) thus does not allow completion of the circuitry until trigger (45) is pulled towards the handle, at which time open circuit/closed circuit switch (43) completes the circuitry so as to drive the motor (11) and the other mechanisms as immediately described above. In addition, handle (5) is open all the way up to strike plate (59) and, as hammer arm (19) is opened and released by cam (17) by its rotation, hammer head (57) strikes strike plate (59) thereby firing the caps. The caps are fed through the strike plate (59) and hammer head (57) and down into spent cap outlet (49) in handle (5) so that the spent caps literally advance out of and ultimately will fall away from or may be pulled out of handle (5). Additionally, optional arm rest (53) is shown and optional silencer (55) is shown to create a realistic appearance.

Figure 2:
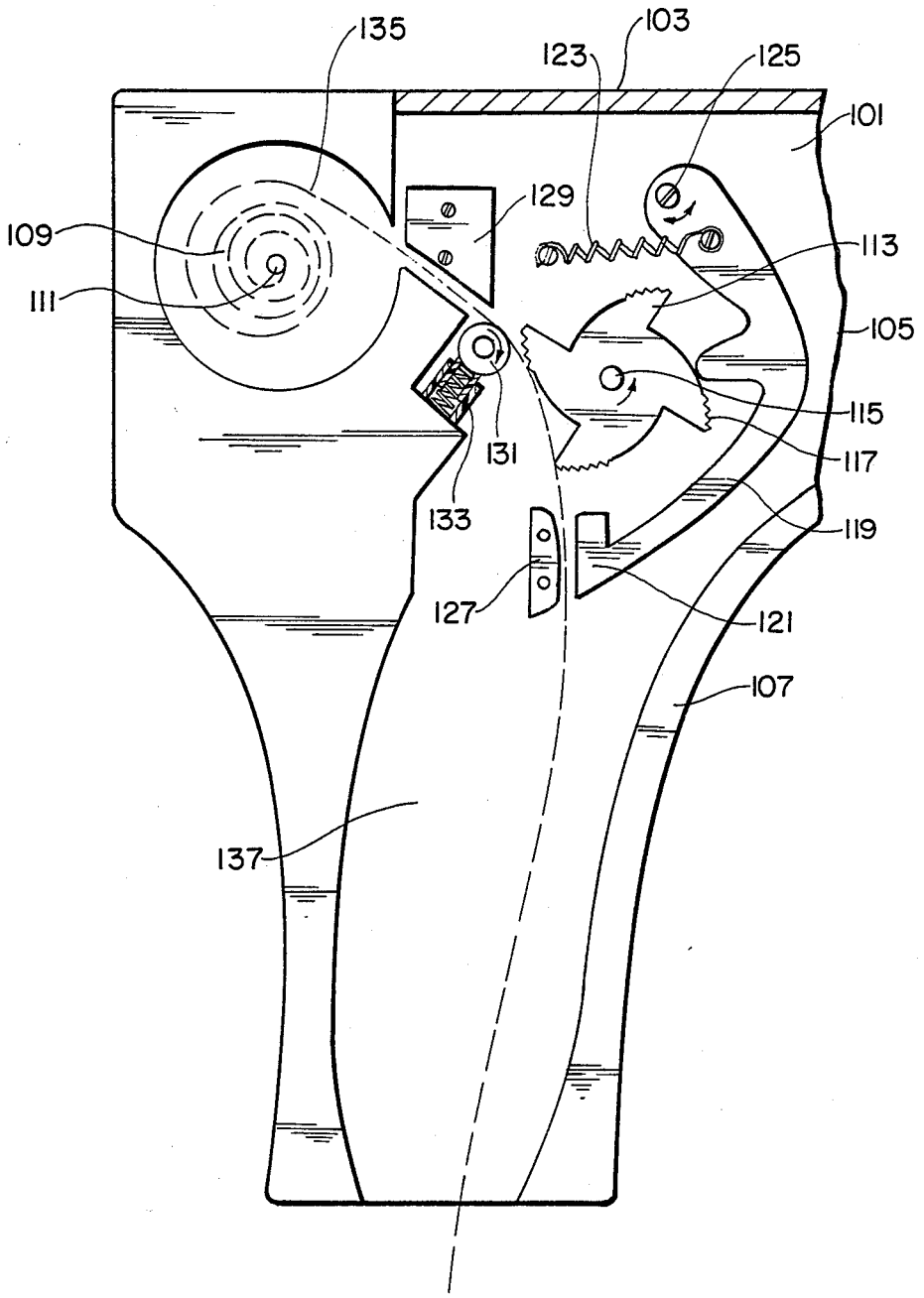

Referring now to FIG. 2, there is shown a side cutauby view of a portion of battery operated toy cap gun (101). It should be noted that this figure illustrates a alternative embodiment to the cam and other aspects of the present invention over that which is shown in FIG. 1 except that a battery compartment could be located on the opposite side not shown along with the drive motor an necessary gearing. In any event, FIG. 2 also illustrates a portion of a toy gun which could be in the form of a pistol or space gun or the like. Toy gun (101) has housing (103) which includes barrel (105) shown only in part and handle (107). Housing (103) also includes cap roll compartment (109) as shown. Cap roll compartment (109) has stationary pin (111) located at its center for insertion of a roll of caps such as is illustrated by the dotted lines as cap roll (135).

Drop off cam (113) is shown having four drop off points so that it may travel at the same rate as the cam shown in FIG. 1 to effect rapid firing twice as fast as that shown in FIG. 1, or it may be slowed down to half the rotational speed to obtain the same number of fires in a given period of time. Obviously, cam (113) could have just one drop off point or three drop off points or the like provided that the appropriate gearing and drive power is provided. Cam (113) rotates in a counterclockwise motion as shown by the arrow located on cam (113) and is driven by drive shaft (115). Also, cam (113) has serrated edges (117) as shown. Cam (113) opens hammer arm (119) four times per cycle and hammer arm (119) has a hammer (121) as well as an anchoring spring (123) and a pin about which it rotates shown as pin (125). Hammer arm (119) opens and closes as shown by the arrow on hammer arm (119) at rotational pin (125). Spring (123) maintains hammer arm (119) biased in a closed direction such that hammer (121) rests against strike plate (127) and upon rotation of cam (113) hammer arm (119) is opened and then released for striking against strike plate (127). Cap roll guide (129) works in conjunction with cap feed roller (131). Spring-loaded shock absorber (133) biases roller (131) against guide (129) so as to hold cap roll (135) in place and as the widest part of cam (113) with serrated edges (117) rotates and presses against the cap roll (135) and roller (131), roller (131) is pushed away from guide (129) and cap roll (135) is advanced such that the next cap is placed on strike plate (127) for firing. As can be seen, cam (113) again operates in a trifunctional fashion so as to open hammer arm (119), open roller (131) and advance cap roll (135).

Obviously, numerous modifications and variations of the present invention are possible in light of the above teachings. It is therefore understood that within the scope of the appended claims, the invention may be practiced otherwise than as specifically described herein.

What is claimed is:

1. A toy cap gun, which comprises:

(a) a housing having the external appearance of a gun which includes a barrel and a handle;

(b) a cap roll compartment located within said housing;

(c) a battery operated cap advancing-repeat firing system located in said housing, which includes:

(i) a drive motor;

(ii) a gear system connected at one end to said drive motor and at the other end to a drive shaft;

(iii) a drive shaft being drivable from and movably connected to said gear system at one end and connected to a cam at its opposite end;

(iv) a trifunctional cam connected to said drive shaft and being drivable thereby and being movably connected to a spring-loaded hammer arm said cam being a stepfunction drop off cam operable to repeatedly open said hammer arm and releasing said hammer arm in a step-function drop off fashion such that spring action will drive said hammer arm against a strike plate to repeatedly fire caps, being operable to open and close a cap roll lock by being biased towards a spring-loaded cap feeder roller, and having cap advance means as a integral part thereof;

(v) a spring-loaded hammer arm pivotably attached to said housing at one end, movably connected to said cam and openable thereby and directed to a strike plate at its opposite end;

(vi) a main spring attached to said hammer arm and having adequate tension upon opening and release to drive said hammer arm against a strike plate to fire caps;

(vii) a stationary strike plate attached to said housing and strikably located at one end of said hammer arm; and, (viii) a cap roll lock and cap roll advance means which includes a cap feeder slide, a lock brace and a spring-loaded cap feeder roller which is movably spring biased against the lock brace and is movable away from the lock brace by cam action;

(d) a battery chamber located within said housing;

(e) electrical circuitry connected to said drive motor and to said battery chamber and including an open circuit/closed circuit switch;

(f) a trigger movably connected to said housing and further connected to said open circuit/ closed circuit switch;

such that when a cap roll is loaded in said compartment and fed to said cap advance means, batteries are placed within said battery chamber and the trigger is pulled, the electrical circuitry is completed within the battery, the aforesaid motor is operated, the motor drives said gears and driveshaft, said cam is rotated and cycled so as to repeatedly open and release said hammer arm so as to repeatedly strike said strike plate to fire caps and said cap roll lock and cap roll advance means is driven to repeatedly lock and unlock and repeatedly advance a cap roll to effect said repeated cap firing.

2. The toy cap gun of claim 1 wherein said battery operated system is operable with batteries having a total of approximately 4.5 volts.

3. The toy cap gun of claim 2 wherein the battery chamber is structured to receive three batteries of AA size.

4. The toy cap gun of claim 1 wherein said step-function drop off cam in a non-uniform rise cam having a plurality of drop offs.

5. The toy cap gun of claim 1 wherein said cam cap advance means consists of raised portions on said cam which press against and advance a cap roll.

6. The toy cap gun of claim 5 wherein said cam raised portions also include serrations.

7. The toy cap gun of claim 1 wherein said handle is open at its bottom and hollow to said strike plate to establish a spent cap outlet

8. The toy cap gun of claim 1 wherein said hammer arm is a crescent arm leaving its pivot point at its upper end and its hammer at its lower end.

9. The toy cap gun of claim 8 wherein said battery operated system is operable with batteries having approximately 4.5 volts.

10. The toy cap gun of claim 9 wherein the battery chamber is structured to receive three batteries of AA size.

* * * * *